US007421223B2

(12) United States Patent
Jodra et al.

(10) Patent No.: US 7,421,223 B2
(45) Date of Patent: Sep. 2, 2008

(54) PRINTING SYSTEM

(75) Inventors: Rodolfo Jodra, Boise, ID (US); Bruce J. Jackson, Star, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 174 days.

(21) Appl. No.: 11/034,038

(22) Filed: Jan. 12, 2005

(65) Prior Publication Data

US 2005/0238971 A1 Oct. 27, 2005

Related U.S. Application Data

(60) Provisional application No. 60/565,243, filed on Apr. 23, 2004.

(51) Int. Cl.
*G03G 15/06* (2006.01)
*G03G 15/08* (2006.01)

(52) U.S. Cl. ..... 399/53; 399/55; 399/213; 347/115; 430/42.1

(58) Field of Classification Search ..... 399/53, 399/55, 213; 430/42.1; 347/115
See application file for complete search history.

(56) References Cited

U.S. PATENT DOCUMENTS

| | | | | |
|---|---|---|---|---|
| 3,663,219 | A | 5/1972 | Takahashi | |
| 3,851,964 | A | 12/1974 | Smith et al. | |
| 4,286,039 | A | 8/1981 | Landa et al. | |
| 4,416,535 | A | 11/1983 | Tottori | |
| 4,572,654 | A | 2/1986 | Murai et al. | |
| 4,742,373 | A | 5/1988 | Nakatani | |
| 5,089,847 | A * | 2/1992 | Folkins | 399/6 |
| 5,119,147 | A | 6/1992 | Hays | |
| 5,136,334 | A | 8/1992 | Camis et al. | |
| 5,155,530 | A | 10/1992 | Larson et al. | |
| 5,155,541 | A | 10/1992 | Loce et al. | |
| 5,184,183 | A | 2/1993 | Karidis et al. | |
| 5,243,391 | A | 9/1993 | Williams et al. | |
| 5,347,345 | A * | 9/1994 | Osterhoudt | 399/231 |
| 5,630,200 | A | 5/1997 | Christy | |
| 5,716,744 | A | 2/1998 | Yergenson | |
| 5,774,771 | A * | 6/1998 | Kukimoto et al. | 430/126 |
| 5,960,232 | A | 9/1999 | Cheng | |
| 6,266,073 | B1 | 7/2001 | Yergenson | |
| 6,904,255 | B2 * | 6/2005 | Kera et al. | 399/299 |
| 2002/0164181 | A1 | 11/2002 | Parker et al. | |
| 2003/0002892 | A1 * | 1/2003 | Saito et al. | 399/302 |

FOREIGN PATENT DOCUMENTS

| | | | |
|---|---|---|---|
| JP | 07-219289 | * | 8/1995 |
| JP | 2002-236392 | * | 8/2002 |

OTHER PUBLICATIONS

Search Report for United Kingdom Patent Application No. GB0507183.2. Search completed Jul. 8, 2005.

* cited by examiner

*Primary Examiner*—Daniel J. Colilla
*Assistant Examiner*—M. Ferguson-Samreth

(57) ABSTRACT

In an implementation of a printing system, an electrophotographic imaging plate electrostatically attracts a first concentration of an ink having a particular color. A developer unit is biased with a developer voltage and the first concentration of the ink is transferred onto the electrophotographic imaging plate from the developer unit according to the developer voltage. The electrophotographic imaging plate then electrostatically attracts a second concentration of the ink. The developer unit is biased with an adjusted developer voltage and the second concentration of the ink is transferred onto the electrophotographic imaging plate from the developer unit according to the adjusted developer voltage.

6 Claims, 4 Drawing Sheets

PRINTING SYSTEM

RELATED APPLICATION

This application claims the benefit of a related U.S. Provisional Application Ser. No. 60/565,243 filed Apr. 23, 2004 entitled "Printing System" to Jodra et al., the disclosure of which is incorporated by reference herein.

BACKGROUND

Printed images are created when a printing system transfers an imaging medium, such as liquid toner (hereinafter referred to as "ink"), onto a print media as dots that form a printed image. Printed images can include any form of printed characters, text, and/or graphics. One of the image attributes that define print quality is whether the dots of the printed image are visible. If the dots that form a printed image are independently visible, then the printed image will appear "grainy" and objectionable rather than as a smooth, clear image. For example, darker in color and/or larger dots are more visible, particularly when printed on white print media.

Some current printing systems attempt to reduce the grainy appearance of a printed image by reducing either the dot size of the dots that form a printed image or the density of the ink to lighten the color of the dots that form the printed image. Other printing systems use additional lighter inks in conjunction with standard darker inks to reduce the grainy appearance of a printed image. The lighter inks produce less visible dots of a printed image which reduces the grainy appearance of the image, such as for highlights where a lighter ink results in less visible dots.

It is typical to have four printing stations in a printing device, one each for the common cyan, yellow, magenta, and black (CYMB) colors. Additional printing stations with the lighter inks may be added to a printing device to produce the lighter colors in a printed image. Accordingly, a printing device may have a printing station with an ink of a standard color (e.g., cyan, yellow, magenta, or black), and an additional printing station with a composition variation of the ink that appears lighter in color in a printed image. These additional printing stations increase both the manufacturing and operational costs of the printing device, and creates a need to develop, manufacture, stock, and distribute the additional lighter inks.

BRIEF DESCRIPTION OF THE DRAWINGS

The same numbers are used throughout the drawings to reference like features and components.

DETAILED DESCRIPTION

In a printing system, voltage-controlled ink density is described as a technique by which one or more of several developer voltages in a printing device can be adjusted to control a printing process such that a single printing station corresponding to a particular ink can print both standard and lighter versions of a color from the same ink source. In an embodiment, a developer voltage for the printing station can be decreased such that fewer ink particles separate from the ink and a thinner layer, or less of a concentration, of the ink is transferred to appear lighter in color when printed as an image on a print media. Conversely, the developer voltage for the printing station can be increased such that more ink particles separate from the ink and a thicker layer, or more of a concentration, of the ink is transferred to appear darker in color when printed as an image on the print media. In an alternate embodiment, a different developer voltage can be increased such that a higher concentration of the ink is transferred to appear darker in color, and the different developer voltage can be decreased such that a lower concentration of the ink is transferred to appear lighter in color.

Accordingly, voltage-controlled ink density implemented in a printing system provides a technique to print images having variations of a particular color from a single printing station. This improves the grainy appearance of printed images by printing a darker version of the particular color over a lighter version of the particular color. Although embodiments of voltage-controlled ink density may be implemented in various printing systems, voltage-controlled ink density is described with reference to the following printing environment.

Figure 1:
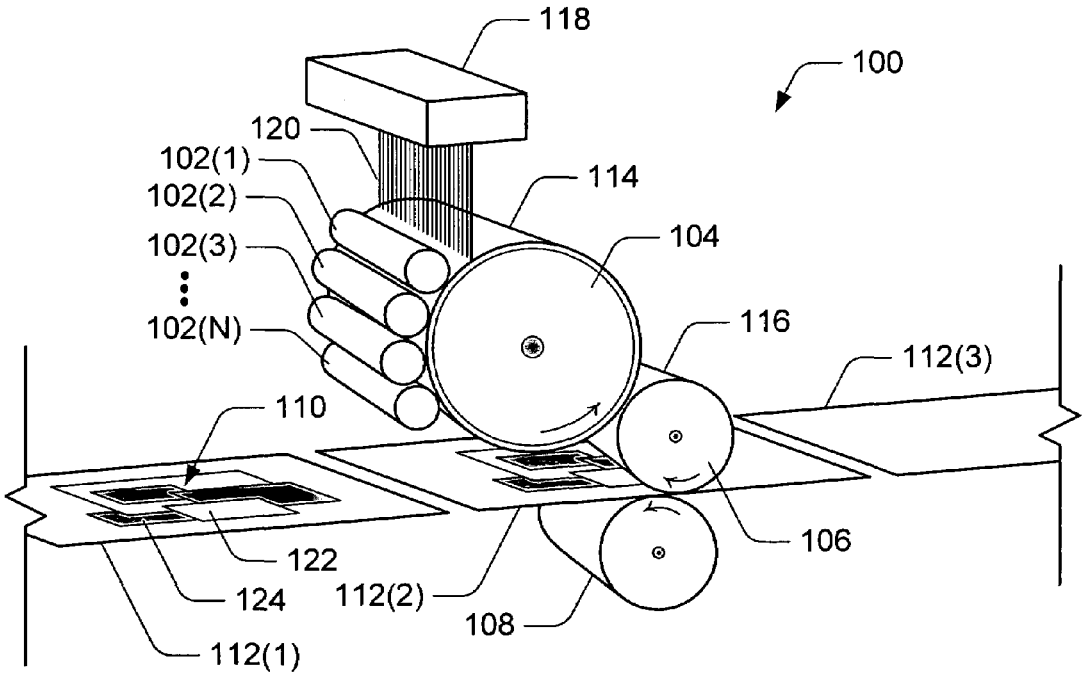
FIG. 1 illustrates various components of an exemplary printing system in which an embodiment of voltage-controlled ink density can be implemented.

FIG. 1 illustrates various components of an exemplary printing system 100 in which an embodiment of voltage-controlled ink density can be implemented. In this example, the various components of printing system 100 are implemented as a liquid electrophotographic (LEP) print system that utilizes electrostatic charge differentials to transfer ink between components, and onto a print media. In an embodiment, the ink implemented in an LEP print system is formulated as electrically charged ink particles suspended in a liquid or liquid-based medium which enables digital printing by electrically controlling the transfer location of the ink particles. Further, printing system 100 may be implemented with any number and combination of differing components as described below with reference to exemplary printing device 400 shown in FIG. 4.

The printing system 100 includes developer units 102 (1 . . . N) that each correspond to a different ink color, such as cyan, yellow, magenta, black (CYMB) and/or any additional lighter versions of the CYMB inks or other special inks. Although only four developer units 102 are shown, the printing system 100 can include any number of the developer units 102(1 . . . N) that each include an ink source to maintain an ink of a particular color, or are connected to an ink source of a particular color.

The printing system 100 also includes an imaging cylinder 104, an intermediate cylinder 106, and an impression cylinder 108 that operate in conjunction with the developer units 102 (1 . . . N) to generate a printed image 110 on a print media 112(1). In this example, three print media 112(1-3) are shown in various stages of a printing process. For example, print media 112(1) includes printed image 110, print media 112(2) is being printed and includes a partial printed image, and print media 112(3) has not passed through the printing system 100.

The imaging cylinder 104 includes an electrophotographic imaging plate 114 that encompasses the imaging cylinder. Similarly, the intermediate cylinder 106 includes an offset pad 116 that encompasses the intermediate cylinder. The offset pad 116 (also commonly referred to as an intermediate "transfer blanket", or "transfer belt") can be implemented as a renewable rubber blanket or pad that acts as a kind of shock absorber to ensure an even application pressure and ink transfer from the offset pad onto the print media 112.

Initially, the electrophotographic-imaging plate 114 (also referred to as a Photo Imaging Plate (PIP)) is electrically charged by rotating the imaging cylinder under a corona wire (not shown), or other similar charging system. This generates electrical charges that tend towards the electrophotographic imaging plate 114 resulting in a uniform static charge over the surface of the electrophotographic imaging plate 114.

An imaging unit 118 includes an array of laser diodes that are controlled by a raster image processor (not shown) which converts data print instructions from a digital file into on/off instructions for each of the laser diodes in the imaging unit 118. As the imaging cylinder 104 rotates, the surface of the electrophotographic imaging plate 114 is exposed with a scanned laser array 120 which exposes image area(s), dissipating (or neutralizing) the electrical charge on the electrophotographic imaging plate 114 in those areas that are exposed. The exposed electrophotographic imaging plate 114 now carries a latent image of the image to be printed in the form of an invisible electrostatic charge pattern that replicates the image to be printed (e.g., printed image 110 on print media 112(1)).

After the electrophotographic imaging plate 114 is exposed to develop the latent image, a developer unit 102 (1 . . . N) of the color to be printed engages the imaging cylinder 104 and transfers ink to the discharged image area(s) on the electrophotographic imaging plate 114. The opposing electrical fields between the electrophotographic imaging plate 114 and the developer unit 102 attracts the ink particles to the discharged image area(s) of the electrophotographic imaging plate 114 and repels them from the non-image areas to form an inked image on the electrophotographic imaging plate 114. In an alternate embodiment, the printing system 100 may be implemented such that the ink particles are attracted to the non-discharged image area(s) of the electrophotographic imaging plate 114 and repelled from the discharged image area(s).

The inked image on the electrophotographic imaging plate 114 is then transferred to the offset pad 116 on the intermediate cylinder 106. The electrophotographic imaging plate 114 rotates into contact with the electrically charged offset pad 116 on the intermediate cylinder 106 and the inked image is electrically transferred to the offset pad. After the inked image is transferred onto the offset pad 116, the imaging cylinder 104 rotates the electrophotographic imaging plate 114 past a cleaning station (not shown) which removes any residual ink and discharges any residual voltage. The electrophotographic imaging plate 114 is then ready to again be electrically charged for the next ink transfer of the image to be printed.

The inked image transferred onto the offset pad 116 is heated to partially melt and blend together the ink particles which forms a hot adhesive liquid plastic. When the intermediate cylinder 106 rotates the offset pad 116 onto the print media 112, the inked image solidifies and transfers from the offset pad 116 onto the print media 112(2) which is held in position by the impression cylinder 108.

For multi-pass image printing, one ink color at a time is transferred from a corresponding developer unit 102 onto the electrophotographic imaging plate 114, and then transferred to the offset pad 116 on the intermediate cylinder 106 and onto the print media 112, as described above. The print media 112 is held in place by the impression cylinder 108 for several iterations, and for several rotations of the imaging cylinder 104 and intermediate cylinder 106 as each successive ink color of the image to be printed is transferred onto the print media 112. For example, the printed image 110 includes varying light printed regions 122 and varying dark printed regions 124 that are each inked one at a time onto the electrophotographic imaging plate 114. The print media 112 is then advanced from the printing system 100 when the final ink color of the printed image is transferred onto the print media 112.

Alternatively, the printing system 100 may be configured such that the inked image is only transferred from the offset pad 116 onto the print media once (e.g., one-pass image printing). The electrophotographic imaging plate 114 is rotated for each successive ink color, transferring the succession of ink colors onto the offset pad 116 and building them up before the final inked image to be printed is transferred onto the print media 112 in one impression pass.

Figure 2:
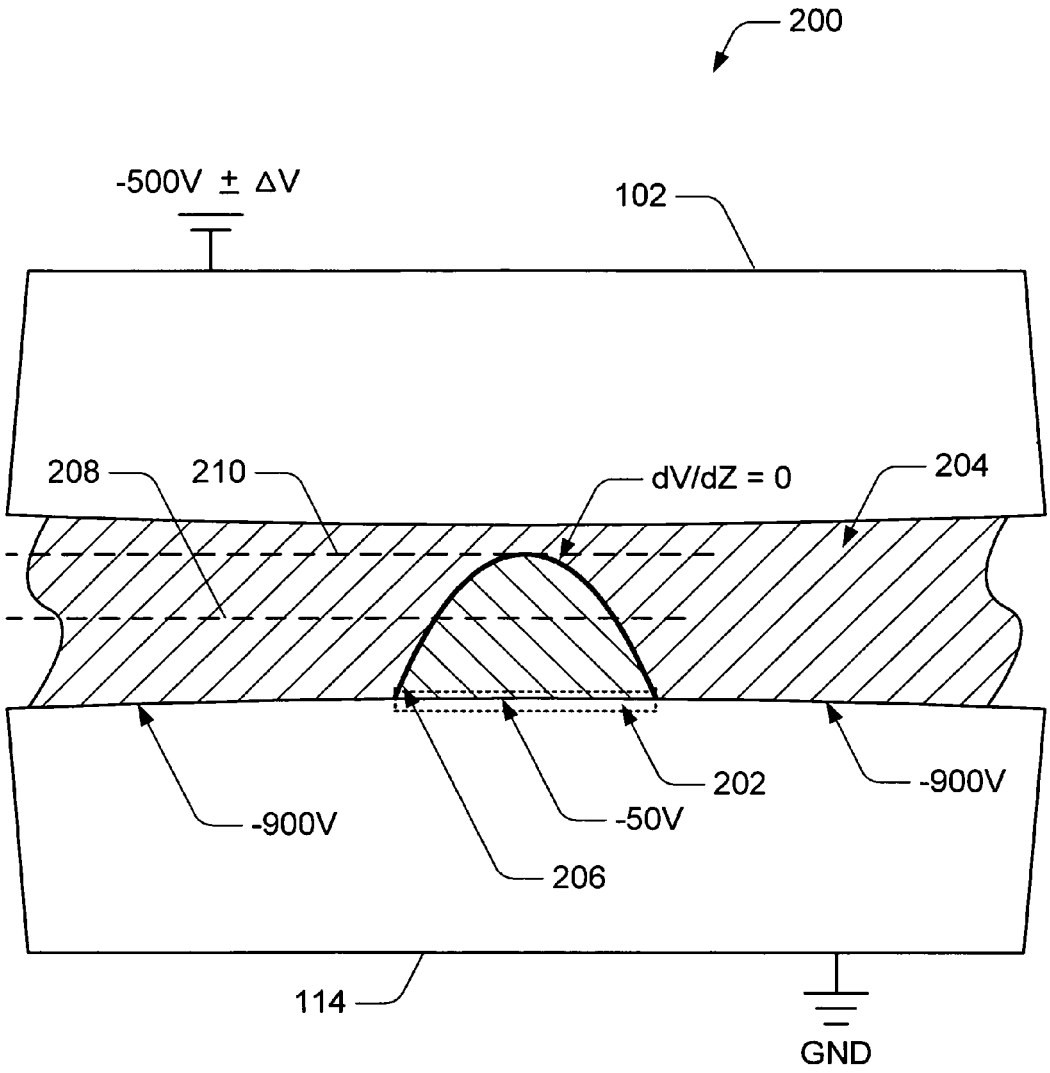
FIG. 2 illustrates an embodiment of voltage-controlled ink density implemented with reference to the exemplary printing system shown in FIG. 1.

FIG. 2 illustrates an embodiment 200 of voltage-controlled ink density implemented with reference to the exemplary printing system 100 shown in FIG. 1. In this example, the electrophotographic imaging plate 114 is uniformly electrically charged at −900V and a developer voltage of −500V±ΔV biases a developer unit 102. The electrophotographic imaging plate 114 has a discharged image area 202 that has a dissipated electrical charge of −50V and which electro-statically attracts ink from the developer unit 102. The discharged image area corresponds to a portion of a latent image of the image to be printed in the form of an electrostatic charge pattern that replicates the image to be printed. In an alternative embodiment, the electrophotographic imaging plate charge voltage and the developer voltage may be inverted such that the developer voltage is less than (i.e., more negative) the charge voltage. Further, the voltages may be positive rather than negative based on implementation and configuration design choices.

The developer voltage of −500V±ΔV that biases developer unit 102 can be generated with any one or more of several developer voltages which can be adjusted to control a printing process. The several developer voltages can include a roller voltage, a squeegee voltage, an electrode voltage, a cleaning roller voltage, and/or any combination of these and other associated developer unit voltages. As referred to herein, the "developer voltage" of −500V±ΔV can be generated and adjusted with any one or combination of the several developer voltages.

An ink layer 204 between the developer unit 102 and the electrophotographic imaging plate 114 includes a concentration, or thickness, of the ink above the discharged image area 202. The concentration of ink above the discharged image area 202 is bounded by a biased ink area boundary 206 which is defined by $dV/dZ \approx 0$ (approximately zero) such that the biased ink area boundary 206 is where the electrical field is approximately zero. The biased ink area boundary 206 may also be defined by such factors as the viscosity of the ink. Accordingly, the ink under the biased ink area boundary 206 is transferred onto the electrophotographic imaging plate 114 from the developer unit 102 while the ink in the ink layer 204 outside of and above the biased ink area boundary 206 is not transferred to the electrophotographic imaging plate 114.

The biased ink area boundary 206 can be controlled, or adjusted, by adjusting the developer voltage (e.g., −500V±ΔV). By increasing the developer voltage (e.g., +ΔV, such as to −300V, for example), the biased ink area boundary 206 is decreased in a direction toward the electrophotographic imaging plate 114 down to a first ink transfer limit 208. Fewer of the ink particles separate from the liquid ink within the biased ink area boundary 206 and a thinner layer, or less of a concentration, of the ink is transferred onto the electrophotographic imaging plate 114 in the discharged image area 202. The decreased concentration of the ink appears lighter in color when printed as an image on the print media 112.

Conversely, by decreasing the developer voltage (e.g., −ΔV which is more negative), the biased ink area boundary 206 is increased in a direction toward the developer unit 102 up to a second ink transfer limit 210. More of the ink particles separate from the liquid ink within the biased ink area boundary 206 and a thicker layer, or more of a concentration, of the ink is transferred onto the electrophotographic imaging plate 114 in the discharged image area 202. The increased concentration of the ink appears darker in color when printed as an image on the print media 112.

Accordingly, the developer voltage can be adjusted to control the printing process such that a single printing station (e.g., developer unit 102) corresponding to a particular ink can print both standard and lighter versions of a color from the same ink source. A printing device that implements voltage-controlled ink density will be less expensive to design, manufacture, and operate because additional developer units 102 for different color variations of one particular ink source are no longer needed to improve the grainy appearance of printed images.

Methods for a printing system, such as exemplary method 300 described with reference to FIG. 3, may be described in the general context of computer executable instructions. Generally, computer executable instructions include routines, programs, objects, components, data structures, procedures, modules, functions, and the like that perform particular functions or implement particular abstract data types.

Figure 3:
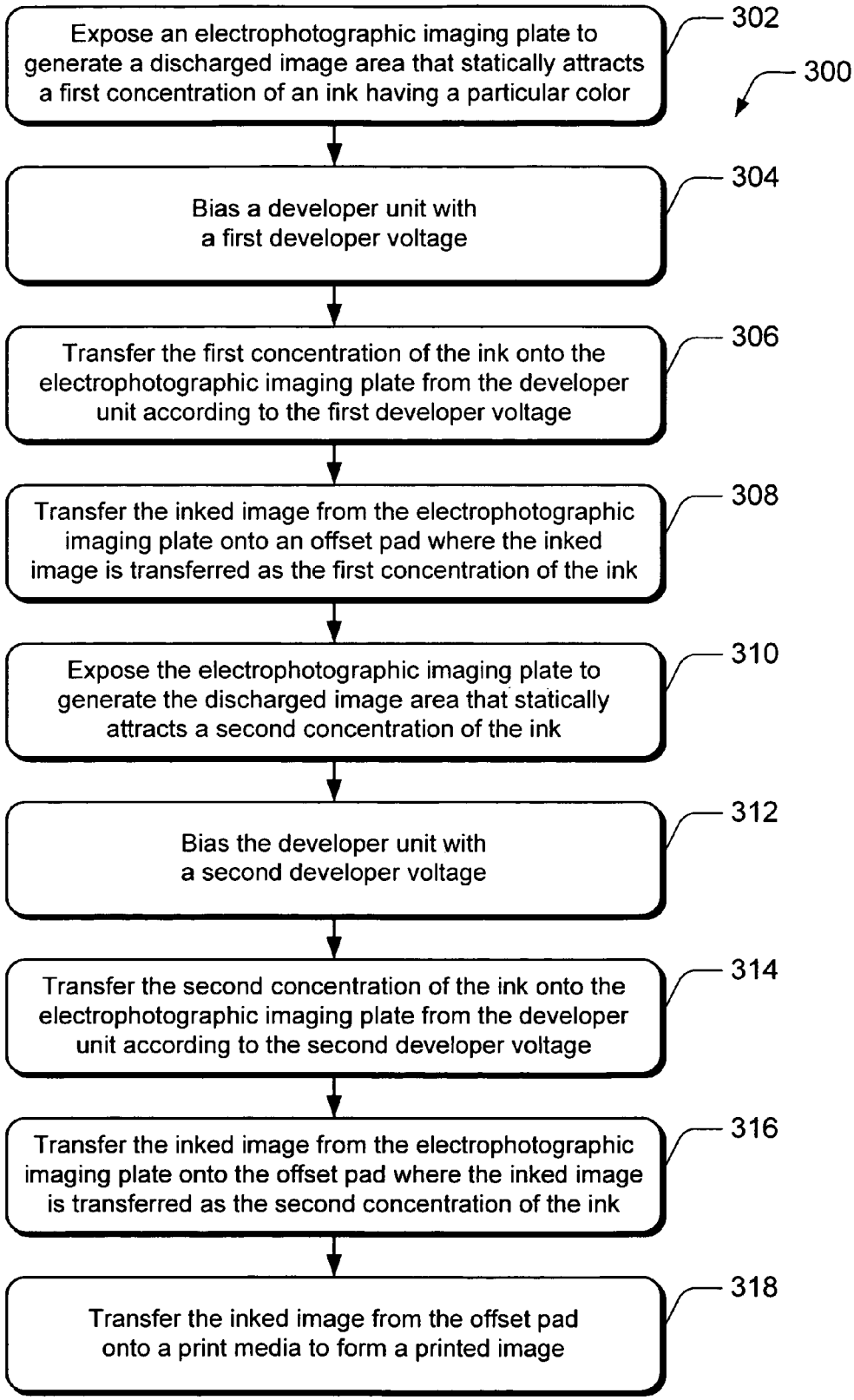
FIG. 3 is a flow diagram that illustrates an embodiment of a method for a printing system.

FIG. 3 illustrates an embodiment of a method 300 for a printing system. The order in which the method is described is not intended to be construed as a limitation, and any number of the described method blocks may be combined in any order to implement the method. Furthermore, the method can be implemented in any suitable hardware, software, firmware, or combination thereof.

At block 302, an electrophotographic imaging plate is exposed to generate a discharged image area that electrostatically attracts a first concentration of an ink having a particular color. At block 304, a developer unit is biased with a first developer voltage. For example, a developer unit 102 (FIG. 2) is biased with a developer voltage −500V+ΔV (such as −300V, for example) and the electrophotographic imaging plate 114 is exposed to generate a discharged image area 202 that electro-statically attracts the concentration of ink under the biased ink area boundary 206. The example developer voltage of −300V can be generated with any one or combination of several developer voltages to bias developer unit 102, such as a roller voltage, a squeegee voltage, an electrode voltage, a cleaning roller voltage, and/or any other associated developer unit voltages.

At block 306, the first concentration of the ink is transferred onto the electrophotographic imaging plate from the developer unit according to the first developer voltage. In an embodiment, the first developer voltage (−500V+ΔV in this example which may be −300V) biases the developer unit 102 such that the first concentration of the ink is transferred as a lighter version, or as a lower concentration, of the particular color. The first developer voltage can be adjusted such that the biased ink area boundary 206 corresponds to the ink transfer limit 208. The first concentration of ink transferred onto the electrophotographic imaging plate 114 is then a thin layer of the ink that appears as a lighter version of the particular color in a printed image.

At block 308, the inked image is transferred from the electrophotographic imaging plate onto an offset pad where the inked image is transferred as the first concentration of the ink. For example, the inked image defined by the first concentration of the ink is transferred from the electrophotographic imaging plate 114 (FIG. 1) onto the offset pad 116. The imaging cylinder 104 rotates the electrophotographic imaging plate 114 to contact the offset pad 116 which encompasses the intermediate cylinder 106.

At block 310, the electrophotographic imaging plate is again exposed to generate the discharged image area that electro-statically attracts a second concentration of the ink. At block 312, the developer unit is biased with a second developer voltage. For example, developer unit 102 (FIG. 2) is biased with a developer voltage −500V and the electrophotographic imaging plate 114 is exposed to generate the discharged image area 202 that electrostatically attracts the concentration of ink under the biased ink area boundary 206. In this example, the second developer voltage of −500V is less than the first developer voltage of −500V+ΔV, such as a first developer voltage of −300V if ΔV=200V. The example developer voltage of −500V can also be generated with any one or combination of the several developer voltages to bias developer unit 102.

At block 314, the second concentration of the ink is transferred onto the electrophotographic imaging plate from the developer unit according to the second developer voltage. In an embodiment, the second developer voltage biases the developer unit 102 such that the second concentration of the ink is transferred as a darker version, or as a higher concentration, of the particular color (i.e., darker with respect to the lighter version of the particular color, or a higher concentration with respect to the lower concentration described with reference to block 306). The second developer voltage can be adjusted such that the biased ink area boundary 206 corresponds to the ink transfer limit 210. The second concentration of ink transferred onto the electrophotographic imaging plate 114 is then a thicker layer of the ink that appears as a darker version of the particular color in a printed image.

At block 316, the inked image is transferred from the electrophotographic imaging plate onto the offset pad where the inked image is transferred as the second concentration of the ink. For example, the inked image defined by the second concentration of the ink is transferred from the electrophotographic imaging plate 114 (FIG. 1) onto the offset pad 116. The imaging cylinder 104 rotates the electrophotographic imaging plate 114 to contact the offset pad 116 which encompasses the intermediate cylinder 106.

At block 318, the inked image is transferred from the offset pad onto a print media to form a printed image. For example, the inked image is transferred from offset pad 116 (FIG. 1) on the intermediate cylinder 106 onto print media 112(2) to form printed image 110 which includes light printed region(s) 122 and dark printed region(s) 124.

Figure 4:
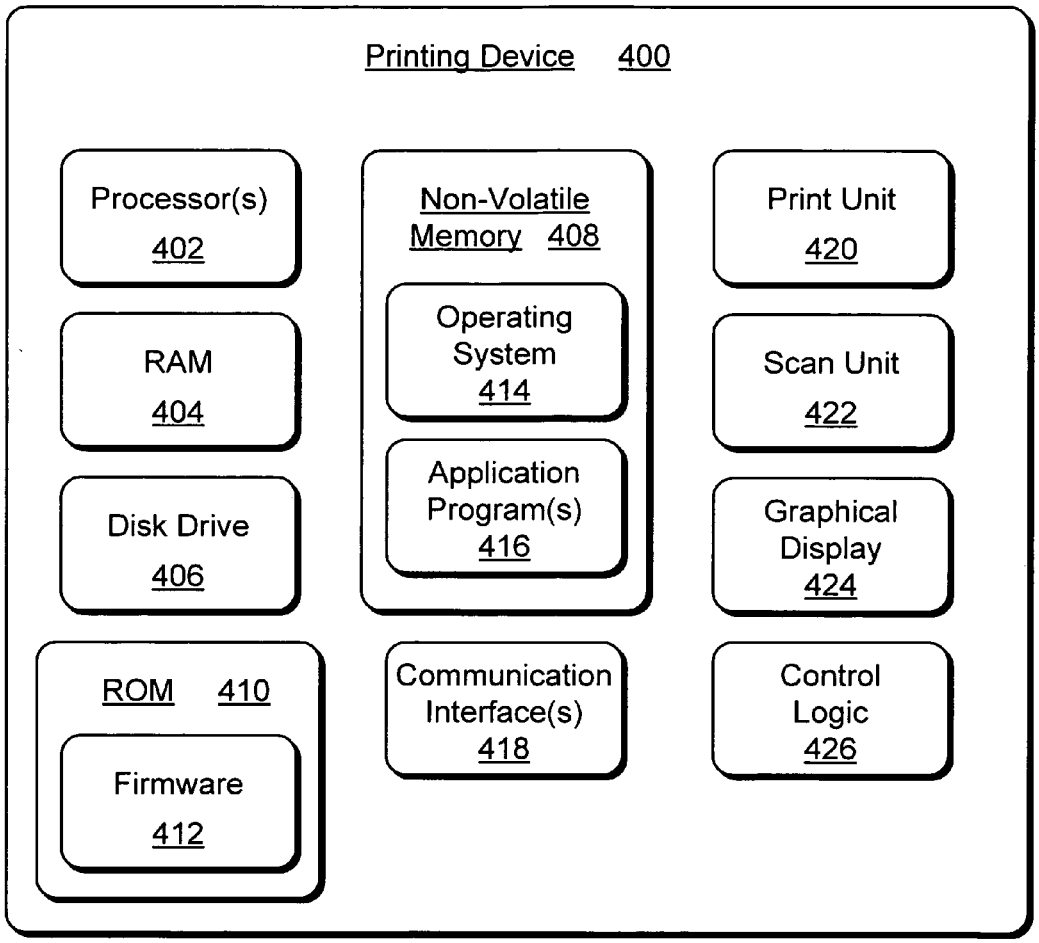
FIG. 4 illustrates various components of an exemplary printing device in which an embodiment of a printing system can be implemented.

FIG. 4 illustrates various components of an exemplary printing device 400 in which voltage-controlled ink density can be implemented. General reference is made herein to one or more printing devices, such as printing device 400 which may be implemented as a commercial printing press that makes use of liquid toner as an imaging medium. As used herein, "printing device" means any electronic device having data communications, data storage capabilities, and/or functions to render printed characters, text, graphics, and/or images on a print media. A printing device may be a printer, fax machine, copier, plotter, and the like. The term "printer" includes any type of printing device using a transferred imaging medium, such as ink, to create an image on a print media. Examples of such a printer can include, but are not limited to, inkjet printers, electrophotographic printers, plotters, portable printing devices, as well as all-in-one, multi-function combination devices.

Printing device 400 may include one or more processors 402 (e.g., any of microprocessors, controllers, and the like) which process various instructions to control the operation of printing device 400 and to communicate with other electronic and computing devices. Printing device 400 can be implemented with one or more memory components, examples of which include random access memory (RAM) 404, a disk drive 406, and non-volatile memory 408 (e.g., any one or more of a ROM 410, flash memory, EPROM, EEPROM, etc.).

The one or more memory components store various information and/or data such as configuration information, print job information and data, digital print data, graphical user interface information, fonts, templates, menu structure information, and any other types of information and data related to operational aspects of printing device 400. Printing device 400 may also include a firmware component 412 that is implemented as a permanent memory module stored on ROM 410, or with other components in printing device 400, such as a component of a processor 402. Firmware 412 is programmed and distributed with printing device 400 to coordinate operations of the hardware within printing device 400 and contains programming constructs used to perform such operations.

An operating system 414 and one or more application programs 416 can be stored in non-volatile memory 408 and executed on processor(s) 402 to provide a runtime environment. Further, application programs 416 can facilitate user interface display and interaction, printing, scanning, and/or any number of other operations of printing device 400. A user interface allows a user of printing device 400 to navigate a menu structure with any of indicators or a series of buttons, switches, or other selectable controls that are manipulated by a user of the printing device.

Printing device 400 further includes one or more communication interfaces 418 which can be implemented as any one or more of a serial and/or parallel interface, a wireless interface, any type of network interface, and as any other type of communication interface. A wireless interface enables printing device 400 to receive control input commands and other information from an input device, such as from an infrared (IR), 802.11, Bluetooth, or similar RF input device. A network interface provides a connection between printing device 400 and a data communication network which allows other electronic and computing devices coupled to a common data communication network to send print jobs, menu data, and other information to printing device 400 via the network. Similarly, a serial and/or parallel interface provides a data communication path directly between printing device 400 and another electronic or computing device.

Printing device 400 also includes a print unit 420 that includes mechanisms arranged to selectively apply an imaging medium such as ink (e.g., liquid toner), and the like to a print media in accordance with print data corresponding to a print job. The print media can include any form of media used for printing such as paper, card stock, plastic, fabric, Mylar, transparencies, film, metal, and the like, and different sizes and types such as 8½×11, A4, roll feed media, etc.

Printing device 400, when implemented as an all-in-one device for example, can also include a scan unit 422 that can be implemented as an optical scanner to produce machine-readable image data signals that are representative of a scanned image, such as a photograph or a page of printed text. The image data signals produced by scan unit 422 can be used to reproduce the scanned image on a display device or with a printing device. Printing device 400 may also include a graphical display 424 that provides information regarding the status of printing device 400 and the current options available to a user through the menu structure.

Although shown separately, some of the components of printing device 400 can be implemented in an application specific integrated circuit (ASIC). Additionally, a system bus (not shown) typically connects the various components within printing device 400. A system bus can be implemented as one or more of any of several types of bus structures, including a memory bus or memory controller, a peripheral bus, an accelerated graphics port, or a local bus using any of a variety of bus architectures. Printing device 400 may also include any form of control logic 426 which refers to hardware, firmware, software, or any combination thereof that may be implemented to perform the logical operations associated with a particular function or with the operability of the printing device 400. Logic 426 may also include any supporting circuitry is utilized to complete a given task including supportive non-logical operations.

Although embodiments of printing systems have been described in language specific to structural features and/or methods, it is to be understood that the subject of the appended claims is not necessarily limited to the specific features or methods described. Rather, the specific features and methods are disclosed as exemplary implementations of printing systems.

The invention claimed is:

1. One or more computer readable media comprising computer executable instructions that, when executed, direct a printing system to:

receive digital print data corresponding to an image to be printed;

determine a light color region of the image;

determine a dark color region of the image;

expose an electrophotographic imaging plate to electrostatically attract a first concentration of an ink corresponding to the light color region of the image;

bias a developer unit with a developer voltage to transfer the first concentration of the ink onto the electrophotographic imaging plate;

expose the electrophotographic imaging plate to electrostatically attract a second concentration of the ink corresponding to the dark color region of the image; and adjust the developer voltage to bias the developer unit to transfer the second concentration of the ink onto the electrophotographic imaging plate.

2. One or more computer-readable media as recited in claim 1, further comprising computer executable instructions that, when executed, direct the printing system to increase the developer voltage to bias the developer unit to transfer the second concentration of the ink onto the electrophotographic imaging plate.

3. One or more computer-readable media as recited in claim 1, further comprising computer executable instructions that, when executed, direct the printing system to decrease the developer voltage to bias the developer unit to transfer the second concentration of the ink onto the electrophotographic imaging plate.

4. One or more computer-readable media as recited in claim 1, further comprising computer executable instructions that, when executed, direct the printing system to rotate an imaging cylinder in conjunction with an intermediate cylinder such that an inked image is transferred from the electrophotographic imaging plate on the imaging cylinder to an offset pad on the intermediate cylinder, the inked image being transferred as the first concentration of the ink and as the second concentration of the ink.

5. One or more computer-readable media as recited in claim 1, further comprising computer executable instructions that, when executed, direct the printing system to:

rotate an imaging cylinder in conjunction with an intermediate cylinder such that an inked image is transferred from the electrophotographic imaging plate on the imaging cylinder to an offset pad on the intermediate cylinder, the inked image being transferred as the first concentration of the ink and as the second concentration of the ink; and rotate the intermediate cylinder in conjunction with an impression cylinder to transfer the inked image from the offset pad on the intermediate cylinder onto a print media to from a printed image on the print media.

6. One or more computer-readable media as recited in claim 1, further comprising computer executable instructions that, when executed, direct the printing system to:

rotate an imaging cylinder in conjunction with an intermediate cylinder such that a first inked image is transferred from the electrophotographic imaging plate on the imaging cylinder to an offset pad on the intermediate cylinder, the first inked image being transferred as the first concentration of the ink;

rotate the intermediate cylinder in conjunction with an impression cylinder to transfer the first inked image from the offset pad on the intermediate cylinder onto a print media to from a printed image on the print media;

rotate the imaging cylinder in conjunction with the intermediate cylinder such that a second inked image is transferred from the electrophotographic imaging plate on the imaging cylinder to the offset pad on the intermediate cylinder, the second inked image being transferred as the second concentration of the ink; and rotate the intermediate cylinder in conjunction with the impression cylinder to transfer the second inked image from the offset pad on the intermediate cylinder onto the print media to from the printed image on the print media.

* * * * *